US006345526B1

(12) United States Patent
Dériaz et al.

(10) Patent No.: US 6,345,526 B1
(45) Date of Patent: Feb. 12, 2002

(54) PUNCHING AND STAMPING MACHINE AND METHOD OF MAKING PARTS USING SAME

(75) Inventors: Daniel Dériaz; Marc Dériaz, both of Meilen ZH; Peter Geser, Oetwil am ZH, all of (CH)

(73) Assignee: Ernst Grob AG, Maennedorf (CH)

( * ) Notice: Subject to any disclaimer, the term of this patent is extended or adjusted under 35 U.S.C. 154(b) by 0 days.

(21) Appl. No.: 09/626,914

(22) Filed: Jul. 27, 2000

(30) Foreign Application Priority Data

Jul. 27, 1999 (EP) ..... 99114647

(51) Int. Cl.[7] ..... B21J 13/00
(52) U.S. Cl. ..... 72/408; 83/623
(58) Field of Search ..... 72/408, 452.3, 72/452.5; 83/557, 623

(56) References Cited

U.S. PATENT DOCUMENTS 656,106 A * 8/1900 Goddard ..... 83/623
2,630,862 A 3/1953 Musser et al.
2,757,731 A * 8/1956 Musly ..... 83/623
2,783,668 A * 3/1957 Frolich ..... 72/408

FOREIGN PATENT DOCUMENTS

EP 0448508 9/1991
GB 2075403 11/1981

* cited by examiner

*Primary Examiner*—Lowell A. Larson
(74) *Attorney, Agent, or Firm*—Crowell & Moring LLP

(57) ABSTRACT

A punching and stamping machine has a movably guided die plate frame, in which an eccentric shaft for the drive of the die is simultaneously disposed. The die plate frame is moved by means of a plate cam which is directly coupled with the eccentric shaft As a result, a forcibly guided movement is achieved between the die and the die plate which, with respect to the workpiece to be machined, is superimposed such that the die carries out only minimal movements with respect to the workpiece and therefore, particularly in the case of a hollow-cylindrical workpiece, permits the machining from the interior side to the exterior. As a result of this forced guidance, very high operating speeds can advantageously be achieved with a high precision.

32 Claims, 3 Drawing Sheets

PUNCHING AND STAMPING MACHINE AND METHOD OF MAKING PARTS USING SAME

BACKGROUND AND SUMMARY OF INVENTION

This application claims the priority of European patent application 99114647.3, filed Jul. 27, 1999, the disclosure of which is expressly incorporated by reference herein.

The present invention relates to a punching and stamping machine having a machine frame, a die, die plate, and a workpiece holder.

Punching and stamping machines are known in many different constructions. The principal tool of these machines is a die which is caused to strike against or strike through the workpiece at high pressure, which workpiece, as a rule, rests on a die plate or against a die plate. The first case involves stamping, the second case involves punching. In the case of a punching, the material in the shape of the die or the die plate is removed from the workpiece; in the case of a stamping, a plastic deformation of the respective material is achieved in the workpiece. There are also mixed forms, in the case of which, for example, bow-type areas are to be formed from an originally closed workpiece surface. In these cases, the concerned area is partially punched out of the workpiece by means of the die but remains connected with the workpiece by way of bridges.

The workpieces worked by means of such machines are predominantly metals, which requires that the forces to be applied by the die must be very large in order to achieve a plastic deformation or separation of the material.

The forces are conventionally transmitted to the die either mechanically by means of an eccentric shaft or hydraulically. As a rule, the conventional mechanical machines have very large dimensions, because the force must be built up and transmitted directly at the site of the die, and are suitable for the machining of large piece parts. Since the pressure buildup takes place separately from the die, the hydraulic machines may also have a smaller construction and are also suitable for machining smaller components.

Specifically when machining cylindrical hollow bodies, problems occur, on the one hand, because of the partly very small dimensions of the workpieces and, on the other hand, during the positioning of the die and the die plate, particularly when the cylindrical workpiece is to be machined along its circumference at certain points frequently situated at regular distances.

Because of the large stroke movements of the die, conventional mechanical machines for machining the workpieces from the inside to the outside cannot be used for small workpieces because these movements cannot be carried out in the interior of the workpiece. The same problem occurs in the case of machines for the machining of workpieces from the outside to the inside because there the die plate cannot carry out the required stroke movement in the interior of the workpiece.

Normally, hydraulic machines are therefore used for this field of application. Although, in this case, the short-stroke die and the die plate are guided on a common guide, they are not forcibly coupled with one another. Among other things, this limits the maximal working speed, which has an effect particularly in the case of workpieces where a large number of punching or stamping operations are to be carried out along their circumference.

It is an object of the present invention to provide a punching and stamping machine which permits a reliable, fast punching or stamping, particularly of hollow-cylindrical workpieces.

According to the invention, this object is achieved by providing a punching and stamping machine having a machine frame, a die, a die plate and a workpiece holder for receiving a workpiece, wherein the die plate is held in a displaceably guided die plate frame which is displaceably guided by way of a plate cam with respect to the workpiece holder in the machine frame, wherein the die is connected with an eccentric shaft which is rotatably disposed in the die plate frame, and wherein the eccentric shaft and the plate cam are directly coupled with one another and are connected with a drive shaft.

This object is also achieved by using this machine to make parts.

By means of the forced coupling of the movement of the die plate and of the die as well as the superimpositions of these two movements with respect to the workpiece to be machined or its holding device, in the case of only a very slight relative movement between the die and the workpiece, a reliable and sufficient punching and stamping effect is achieved onto the workpiece. This allows the die to act also from the interior side of hollow-cylindrical workpieces with relatively small internal radii toward the outside. However, in this case, the die can nevertheless be dimensioned to be sufficiently large for permitting the force transmission without any risk of breakage or deformation also at high machining speeds. The same applies when the workpieces are machined from the outside, in the case of which the die plate is arranged on the interior side of the workpiece and advantageously can also be dimensioned to be sufficiently large. In addition, as a result of the forced coupling of the die and the die plate, a high precision of the stamping or punching is achieved.

The plate cam is preferably coupled with the eccentric shaft to be adjustable at the relative torsion angle in order to adapt the movements with respect to the workpiece holder and the workpiece corresponding to the requirements. The shape of the plate cam will also be adapted corresponding to the requirements. Thus, a machine according to the invention, for example, may have a set of different plate cams which are used depending on the demand or application.

When preferably the drive of the eccentric shaft takes place by way of a controlled servo shaft, the precision and adjustability can be further increased, and, in synchronization with the controlling of a workpiece holder which is preferably further developed rotatably by way of a servo motor, stamping and punching of hollow-cylindrical workpieces can take place along their circumference at high machining speeds and with high precision.

Even if preferably hollow-cylindrical workpieces can advantageously be machined by means of such a machine, its use is not limited solely to that purpose.

Other objects, advantages and novel features of the present invention will become apparent from the following detailed description of the invention when considered in conjunction with the accompanying drawings.

DETAILED DESCRIPTION OF THE DRAWINGS

Figure 1:
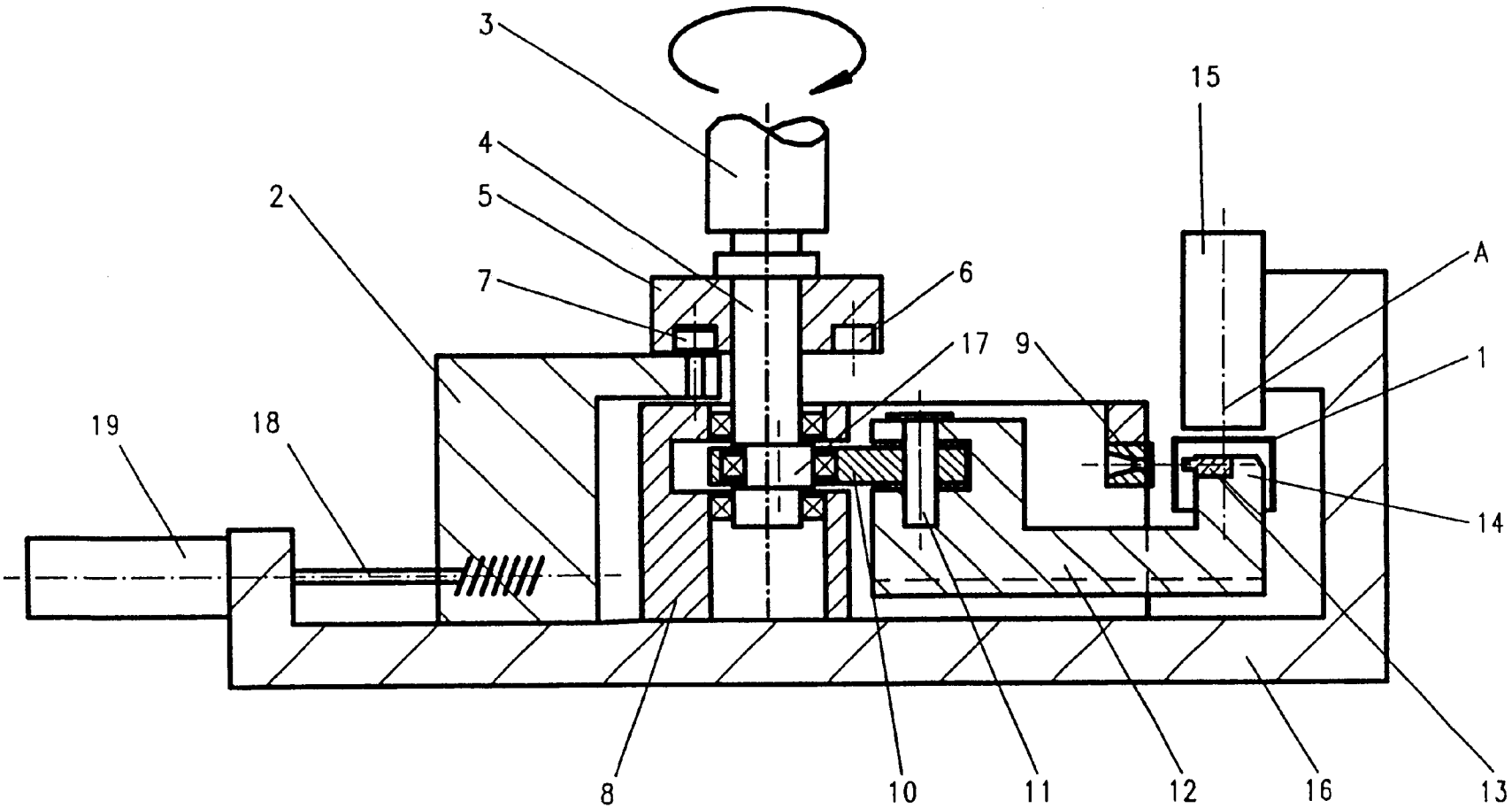
FIG. 1 is a schematic longitudinal sectional view of a machine according to the invention with a hollow-cylindrical workpiece which is machined from the interior side by means of the die.

FIG. 1 is a schematic longitudinal sectional view of a punching and stamping machine according to the invention. The workpiece 1 to be machined is held by means of a workpiece holder 15, which is connected with the machine frame 16, in the illustrated position to be rotatable about the workpiece axis A. The eccentric shaft 4 is driven by way of a drive shaft 3, constructed, for example, a cardan shaft. The torsion angle of the plate cam 5 with respect to the eccentric shaft 4 is preferably adjustable, either continuously or in discrete steps. This adjustment is, as a rule, carried out when the machine is set up. However, a controlled motor-driven adjustment would also be conceivable which can be activated during the operation or during interruptions of the operation. In the illustrated embodiment, the eccentric shaft 4 is arranged coaxially with respect to the plate cam 5. However, an eccentric separate arrangement is also conceivable.

On its underside, the plate cam 5 has a control path in the form of a surrounding groove 6. The groove 6 can, for example, be constructed as a circular or elliptical groove constructed eccentrically with respect to the axis of rotation of the eccentric shaft or may have an arbitrary closed shape. A pin 7 engages in this groove 6, which pin 7 is connected with the feed carriage 2.

The feeding of the feed carriage 2 can be adjusted radially to the workpiece 1 by way of a threaded spindle 18 by a mechanical or electric drive 19 which is fixedly connected with the machine frame 16. It is used for setting up the machine to the desired workpiece diameter or the workpiece diameter to be machined.

The eccentric shaft 4 is disposed in the die plate frame 8 which is displaceably guided radially with respect to the workpiece axis A in the machine frame 16. During the drive of the drive shaft 3, the die plate frame 8, corresponding to the construction of the groove 7 of the plate cam 5, is periodically moved back and forth in its guide, whereby the die plate 9 arranged at the end of the die plate frame 8 comes to a stop against the edge of the workpiece 1 or is lifted off it. Corresponding to the construction of the groove 6, this movement takes place by means of a larger or smaller path, in each case once per rotation.

On the eccentric pin 17 of the eccentric shaft 4, a connecting rod 10 is arranged which is connected, for example, by way of a connection pin 11, with the die arm 12. This die arm 12 is also arranged displaceably in the radial direction with respect to the workpiece axis A in the die plate frame 9. During the rotation of the eccentric shaft 4, the die arm 12 is therefore also moved once back and forth during each rotation along with the die 13 arranged at the end of the die arm.

By means of the illustrated arrangement of the eccentric shaft 4, the plate cam 5 and the eccentric pin 17, a coupled, forcibly guided movement is caused of the die plate 9 as well as of the die 13, in which case the relative movement of the die 13 with respect to the workpiece axis A, depending on the construction and the arrangement of the groove 6 of the plate cam 5, can be very small in comparison to the stroke of the eccentric pin 17.

As a result, it is achieved that the die head 14 of the die arm 12 can virtually take up the whole interior of the workpiece 1 without any influence on the actual stroke of the die 13 which corresponds to the stroke of the eccentric pin 17. This has the decisive advantage that the die arm 12 can have a sufficiently stiff construction corresponding to the applied stamping and punching force in order to, on the one hand, avoid damage during the operation and, on the other hand, carry out the punching and stamping with a very high reproducible precision.

Figure 2:
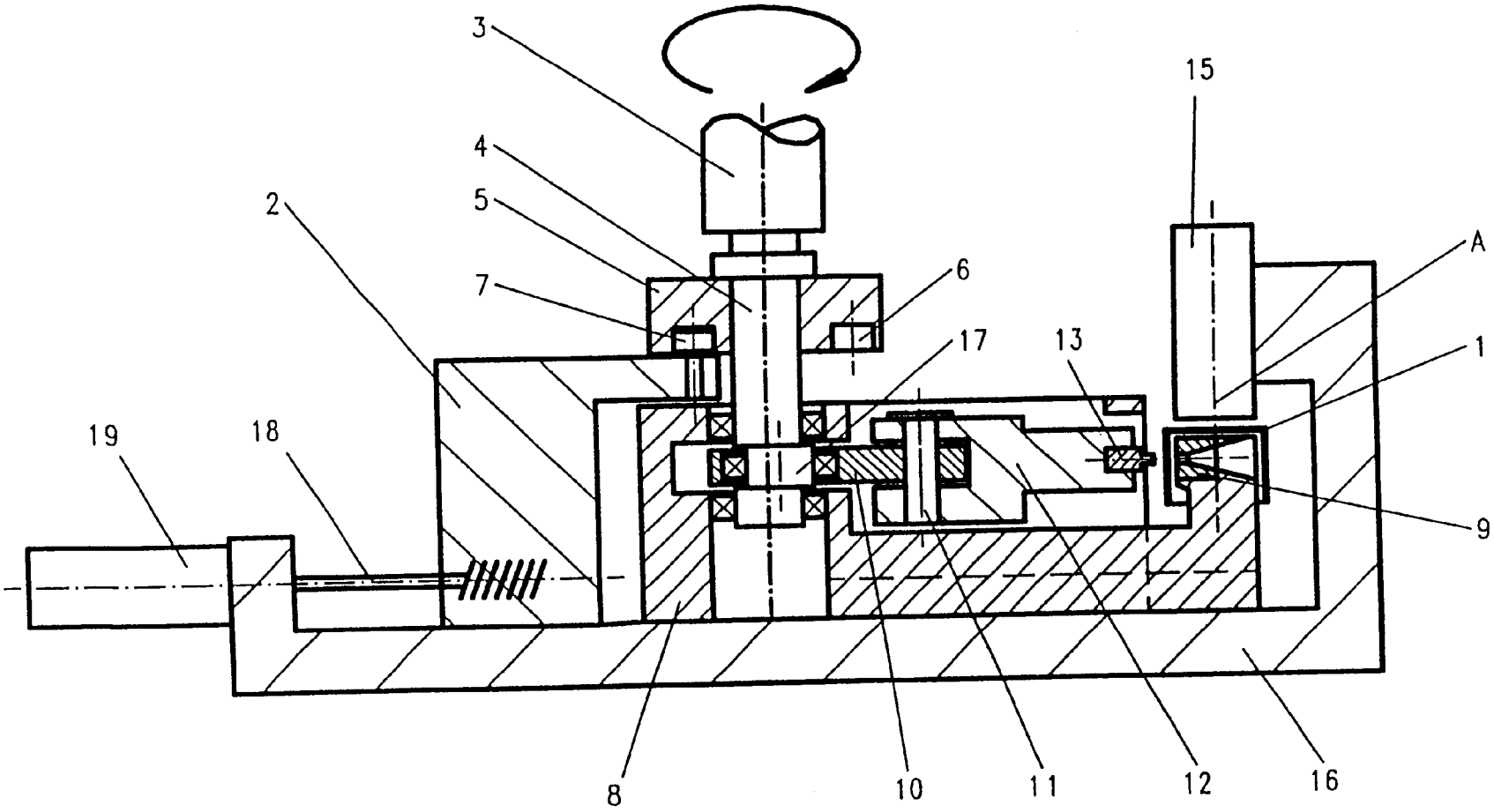
FIG. 2 is a schematic longitudinal sectional view of a machine according to the invention with a hollow-cylindrical workpiece which is machined from the exterior by means of the die.

Naturally, the illustrated arrangement can also be used for letting the die 13 act upon the workpiece 1 from the exterior side and, in the process, causing the die plate 9 to strike against the interior side of the workpiece 1, as illustrated in FIG. 2. The construction is basically identical to that according to FIG. 1, only the die plate frame 8 and the die arm 12 have a correspondingly different design.

Figure 3:
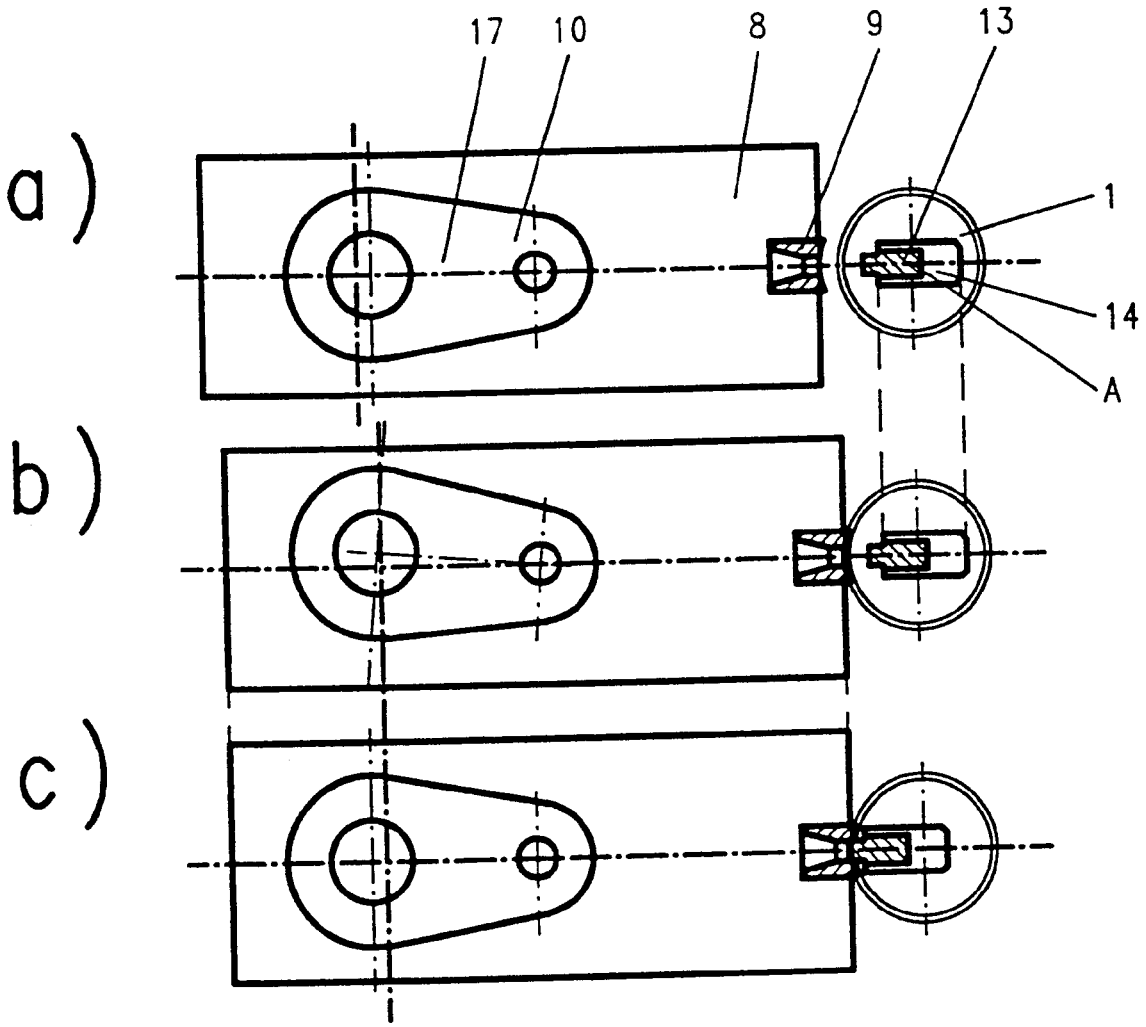
FIGS. 3*a*) to *c*) are schematic top views of the working range of the machine according to FIG. 1 in three different positions.

FIGS. 3*a*) to 3*c*) are schematic top views of the working range of the above-described machine according to the invention. FIG. 3*a* shows the starting position of the machine which is also illustrated in FIG. 1, in which the die plate 9 as well as the die 13 have the largest distance from the surface of the workpiece 1 to be worked. In this case, the workpiece holder or the workpiece 1 is stationarily arranged with respect to the machine frame 16; the die plate frame 8 is in its most rearward position, that is, on the left side in the figure; and the die arm 12 is in its most forward position, that is, toward the right side.

When the drive shaft 3 is rotated counterclockwise, it is displaced, as a result of the further development of the plate cam 5 and of the groove 6, to the right toward the workpiece 1, as illustrated in FIG. 2*b*. The groove 6 of the plate cam 5 is designed such that the displacement is so large that the die plate 9 just comes in contact with the outer wall of the workpiece 1. Preferably, this position has already been reached after a rotating movement of approximately 90 ° –110° from the starting position and is then maintained. This is achieved in that, in this subsequent angular range, the groove 6 has a constant radius with respect to the axis of the drive shaft 3, thus has a concentrically circular design. As a result of the corresponding movement of the eccentric pin 17, the die 13, by way of the die arm 12 and the connecting rod 10, has now been displaced toward the left with respect to the die plate frame 8 but, with respect to the axis A of the workpiece, is virtually still at the same site. As a result, the relative movement with the stroke required corresponding to the applied torque has now already been prepared, which is necessary for the punching and stamping machining.

Only in the last range of half the rotation of the drive shaft 3, the die 13 will now also be moved toward the left with respect to the workpiece 1 and carry out the intended machining, as illustrated in FIG. 3*c*, in the position after half a rotation by 180° from the inoperative position.

During the subsequent further rotation by 180° back into the starting position, the die 13 and the die plate 9 are detached from the workpiece 1 in the reverse order. In this case, the workpiece 1 can be rotated, for example, about its axis A into the next position, corresponding to the machining requirements.

If now preferably a controlled servo shaft is used as the drive of the drive shaft 3, the control system can precisely control this servo shaft as well as the rotation of the workpiece holder 15. As a result, hollow-cylindrical workpieces can be punched or stamped from the interior side with a very high precision and at a high operating speed.

The shape of the groove 6 of the plate cam 5 is defined as a function of the stroke of the eccentric pin 17, of the machining mode, of the size of the die head 14 and of the cross-sectional shape and design of the workpiece 1. As a rule, it will have an oval symmetrical design.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Punching and stamping machine having a machine frame, a die, a die plate and a workpiece holder for receiving a workpiece, wherein the die plate is held in a displaceably guided die plate frame which is displaceably guided by way of a plate cam with respect to the workpiece holder in the machine frame, wherein the die is connected with an eccentric shaft which is rotatably disposed in the die plate frame, and wherein the eccentric shaft and the plate cam are directly coupled with one another and are connected with a drive shaft.

2. Punching and stamping machine according to claim 1, wherein the plate cam is arranged directly on the axis of the eccentric shaft.

3. Punching and stamping machine according to claim 2, wherein the plate cam is constructed to be adjustable in its torsion angle with respect to the eccentric shaft.

4. Punching and stamping machine according to claim 1, wherein the plate cam has at least one surrounding groove in which a pin of a feeding carriage engages.

5. Punching and stamping machine according to claim 2, wherein the plate cam has at least one surrounding groove in which a pin of a feeding carriage engages.

6. Punching and stamping machine according to claim 1, wherein the die is connected with the eccentric shaft by way of a connecting rod.

7. Punching and stamping machine according to claim 2, wherein the die is connected with the eccentric shaft by way of a connecting rod.

8. Punching and stamping machine according to claim 3, wherein the die is connected with the eccentric shaft by way of a connecting rod.

9. Punching and stamping machine according to claim 4, wherein the die is connected with the eccentric shaft by way of a connecting rod.

10. Punching and stamping machine according to claim 1, wherein the die is arranged on a die arm which is guided to be displaceable in a straight line.

11. Punching and stamping machine according to claim 2, wherein the die is arranged on a die arm which is guided to be displaceable in a straight line.

12. Punching and stamping machine according to claim 3, wherein the die is arranged on a die arm which is guided to be displaceable in a straight line.

13. Punching and stamping machine according to claim 4, wherein the die is arranged on a die arm which is guided to be displaceable in a straight line.

14. Punching and stamping machine according to claim 6, wherein the die is arranged on a die arm which is guided to be displaceable in a straight line.

15. Punching and stamping machine according to claim 10, wherein the die arm is guided in the die plate frame.

16. Punching and stamping machine according to claim 11, wherein the die arm is guided in the die plate frame.

17. Punching and stamping machine according to claim 12, wherein the die arm is guided in the die plate frame.

18. Punching and stamping machine according to claim 13, wherein the die arm is guided in the die plate frame.

19. Punching and stamping machine according to claim 14, wherein the die arm is guided in the die plate frame.

20. Punching and stamping machine according to claim 1, wherein the eccentric shaft is disposed in the die plate frame.

21. Punching and stamping machine according to claim 2, wherein the eccentric shaft is disposed in the die plate frame.

22. Punching and stamping machine according to claim 3, wherein the eccentric shaft is disposed in the die plate frame.

23. Punching and stamping machine according to claim 4, wherein the eccentric shaft is disposed in the die plate frame.

24. Punching and stamping machine according to claim 6, wherein the eccentric shaft is disposed in the die plate frame.

25. Punching and stamping machine according to claim 10, wherein the eccentric shaft is disposed in the die plate frame.

26. Punching and stamping machine according to claim 1, wherein the eccentric shaft is connected with an electric motor, preferably with an NC servo motor, or a hydromotor.

27. A method of making parts from hollow workpieces using a punching and stamping machine having a machine frame, a die, a die plate and a workpiece holder for receiving a workpiece, wherein the die plate is held in a displaceably guided die plate frame which is displaceably guided by way of a plate cam with respect to the workpiece holder in the machine frame, wherein the die is connected with an eccentric shaft which is rotatably disposed in the die plate frame, and wherein the eccentric shaft and the plate cam are directly coupled with one another and are connected with a drive shaft, said method comprising:

disposing one of the die plate and die inside the work piece and the other of the die plate and die outside the workpiece, and operating the machine to sequentially move the die and die plate toward one another to machine the workpiece.

28. A method according to claim 27, wherein the hollow workpiece is cylindrical with cylindrical walls which extend substantially perpendicular to a direction of relative moment of the die and die plate during machining operations.

29. A method according to claim 28, wherein the die plate is disposed inside the workpiece and the die is disposed outside the workpiece during machining operations.

30. A method according to claim 28, wherein the die plate is disposed outside the workpiece and the die is disposed inside the workpiece during machining operations.

31. A method according to claim 27, wherein the plate cam is arranged directly on the axis of the eccentric shaft.

32. A method according to claim 27, wherein the plate cam has at least one surrounding groove in which a pin of a feeding carriage engages.

* * * * *